United States Patent [19]

Halonen

[11] 4,190,190

[45] Feb. 26, 1980

[54] STRIP MADE UP OF CONSECUTIVE PACKAGE BLANKS

[75] Inventor: Tuomo Halonen, Toijala, Finland

[73] Assignee: Okuli Oy, Toijala, Finland

[21] Appl. No.: 905,035

[22] Filed: May 9, 1978

[51] Int. Cl.[2] ..... B65D 5/72

[52] U.S. Cl. ..... 229/17 R

[58] Field of Search ..... 229/17 R, 17 G, DIG. 4

[56] References Cited

U.S. PATENT DOCUMENTS

| | | | |
|---|---|---|---|
| B 461,257 | 1/1976 | Larsson et al. | 229/DIG. 4 |
| 2,416,332 | 2/1947 | Lehman | 229/17 R X |
| 3,549,080 | 12/1970 | Gill | 229/17 R |

*Primary Examiner*—Davis T. Moorhead

*Attorney, Agent, or Firm*—Haseltine, Lake & Waters

[57] ABSTRACT

A strip made up of consecutive package blanks has been described. This strip consists of cardboard and has continuous longitudinal folding lines, which divide each blank into longitudinal zones, and in each blank four transversal folding lines which divide the blank into five transversal zones. Thus each blank can be folded to become a package wherein the centermost transversal zone constitutes the rectangular sides of the package, the transversal zones following on either side and which have on the areas of the longitudinal zones, which in the folding process come to be opposite each other, oblique folding lines enabling a folding up constitute the ends of the package and the edgemost transversal zones constitute at the ends seams which close the package. The seams are formed by cardboard layers that are lying against each other and bonded together with the aid of plastic. Those longitudinal zones, in which the oblique folding lines are located, present on the dividing line between consecutive blanks in the cardboard apertures which have been covered with a plastic layer so that when the blanks are being folded the plastic covering the apertures will be doubled at the seams to be sandwiched between two opposed cardboard layers forming the seam.

4 Claims, 7 Drawing Figures

STRIP MADE UP OF CONSECUTIVE PACKAGE BLANKS

The forming of packages from a strip comprising consecutive blanks is a commonly employed procedure in the manufacturing of cardboard packages. The procedure is particularly well applicable when the package does not obtain its ultimate shape until at the step when it is filled. For instance, in the packaging of liquid foodstuffs one may first fold the strip along the longitudinal folding lines to become a tube into which the liquid that is being packed is supplied. The folding and seaming of the ends of the package will then take place below the liquid level so that the top end of the lower package and the bottom of the upper package are simultaneously formed. Only hereafter are the packages detached from each other by cutting. The shape of the completed package folded from a blank forming part of the strip is a rectangular parallelepipedon, the upper end of which may not only be straight but may also be composed of two flats projecting at a slant. The shape of the upper end of the package depends on the proportions between the breadths of the longitudinal zones of the strip and the transversal zones which are going to be folded to become the top ends.

The seams located in the ends of the package are formed of the edgemost transversal zones of the blank. When making the packages most commonly occurring in practice which have a square cross section, the place of the seam will be composed of four cardboard layers one upon the other. The plastic material required in the seaming process is present already as a course applied on the cardboard, and the seaming is carried out with the aid of a hot seaming roll, which melts the plastic.

Strips belonging to the state of art have the drawback that at the seaming points on the ends of the package only that amount of plastic is available for bonding the cardboard layers which is present on the surfaces of the blanks' edgemost transversal zones. To produce a leak-free seam with such a small amount of plastic is difficult, and the adding of extra plastic to the seaming point would make the manufacturing process awkward and complex. However, in the case of packages containing a liquid product leak-free condition of the seams is an altogether absolute requirement.

The object of the present invention is to eliminate the drawback and to form a strip where on the ends of the packages therefrom folded leak-free seams are produced. The invention is characterized in that those longitudinal zones in which the oblique folding lines are found have on the dividing line between consecutive blanks, in the cardboard, apertures which have been covered over with a plastic layer so that as the blanks are folded the plastic covering the apertures will be folded at the points to be seamed to be interposed between two cardboard layers lying against each other. In this way an extra amount of plastic is obtained for the points to be seamed and which ensures the tight and leak-free adhesion between the cardboard courses placed against each other. Since at the same time the seam comprises a smaller number of cardboard layers to be joined together, the chances for leaks to be incurred are less for this reason as well.

An embodiment of the invention, concerning a strip formed of plastic-coated cardboard, is characterized in that the plastic covering of the cardboard continues on both sides of the strip over the apertures so that each aperture is covered by two superimposed plastic layers. A strip of this kind is almost as easy to manufacture as a plastic-coated strip without apertures.

Another advantageous embodiment of the invention is characterized in that the length of the apertures is the same as the breadth of those longitudinal zones in which the apertures are found. In that case there will be formed at the point to be seamed, a zone extending from one end to the other of the seam and which comprises only two cardboard layers lying against each other, and where the plastic which covered the adjacent apertures in the strip has been folded up to be sandwiched between these cardboard layers. If desired, the apertures may also be formed so that their breadth is the same as the added breadth of the edgemost transversal zones bordering on the dividing line between the two consecutive blanks. The apertures will then comprise the areas jointly delimited by said transversal zones and the longitudinal zones displaying oblique folding lines. When the blanks of such a strip are being folded to form packages, the plastic layers covering adjacent apertures will be folded double on the whole area of the end seams. This embodiment may for instance be employed when the package has a rectangular cross section.

The invention is described in detail in the following with the aid of examples, with reference to the attached drawing, wherein:

FIG. 1 presents part of a strip of the invention, showing one package blank in its entirety.

Figure 1:
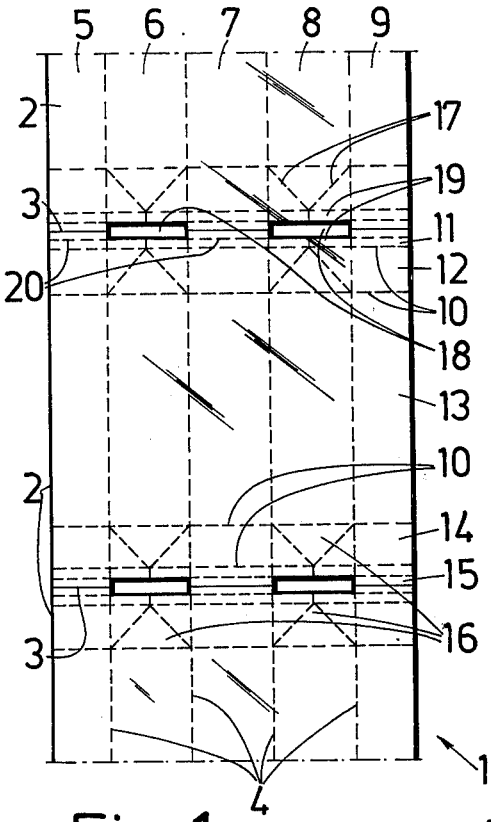

In FIG. 1 is shown the strip 1 consisting of plastic-coated cardboard and which is composed of consecutive package blanks 2. The figure displays one blank in its entirety and part of the next blanks following on each side thereof. The dividing lines 3 between blanks 2 have been indicated with a solid line in the figure. Dotted lines in the figure indicate the folding lines along which each blank 2 can be folded to become a package. The strip 1 comprises four parallel, longitudinal folding lines 4, which divide each blank 2 into five longitudinal zones 5 to 9. The combined breadth of the edgemost longitudinal zones 5, 9 is slightly more than the width of the three central, equally wide longitudinal zones 6 to 8. Each blank 2 of the strip 1 further comprises four transversal folding lines 10, which divide the blank into five transversal zones 11 to 15. Of these zones, the centremost transversal zone 13 constitutes the major part of the length of the blank 2, the transversal zones 12, 14 following on both sides thereof, which are mutually equal in width, having a width one half of that of the centremost longitudinal zones 6 to 8, and the mutually equally wide edgemost transversal zones 11,15 having a width less than half the width of zones 12 and 14. The blanks 2 of the strip as shown in FIG. 1 can be folded to become packages with the shape of a rectangular parallelepipedon where the centremost transversal zone of the blank, 13, forms the four sides with rectangular shape of the package, the next transversal zones 12 and 14 form the square shaped ends of the package and the edgemost transversal zones 11 and 15 form the seams on the ends. To the purpose of folding the ends, the strip 1 displays oblique folding lines 17 which have been produced in the areas 16 delimited by the longitudinal zones 6 and 8 and by the transversal zones 12 and 14 and which run at an angle of 45° with reference to the longitudinally and transversally running folding lines 4, 10. Owing to the folding lines 17, the areas 16 may in connection with the folding be folded down under the areas confined by the zones 5, 7, 9, 12 and 14.

The strip of FIG. 1 furthermore comprises apertures 18 covered with a plastic layer, these apertures being located on the boundaries 3 between blanks 2, in the longitudinal zones 6 and 8. The length of these rectangularly shaped apertures 18 is the same as the breadth of the longitudinal zones 6 and 8. Between the sides of the apertures 18 and the transversal folding lines confining the edgemost transversal zones 11 and 15 there remain lands 19, which can be folded double at their middle. Between the apertures located adjacent to each other there are folding lines 20 dividing the zones 11 and 15 in two in their middle and which facilitate the folding of the package ends and their seaming.

Figure 2:
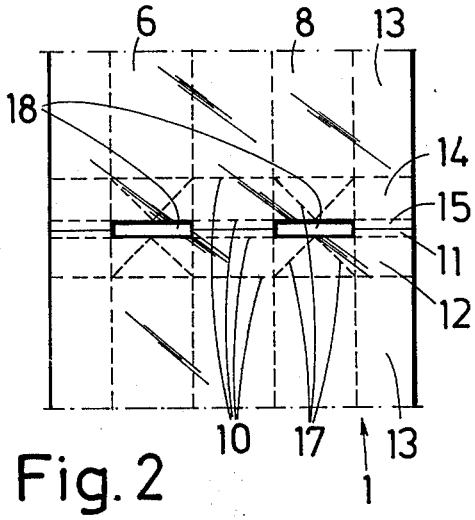
FIG. 2 shows part of a strip according to another embodiment of the invention.

The strip 1 shown in FIG. 2 differs from that just described in that the width of the plastic-covered apertures 18 equals the combined width of the edgemost transversal zones 11 and 15. Now the transversal folding lines confining the said zones 11 and 15, that is the lines 10, coincide with the sides of the apertures 18 and the lands 19 and folding lines 20 which are part of the embodiment of FIG. 1 are lacking here.

Figure 3:
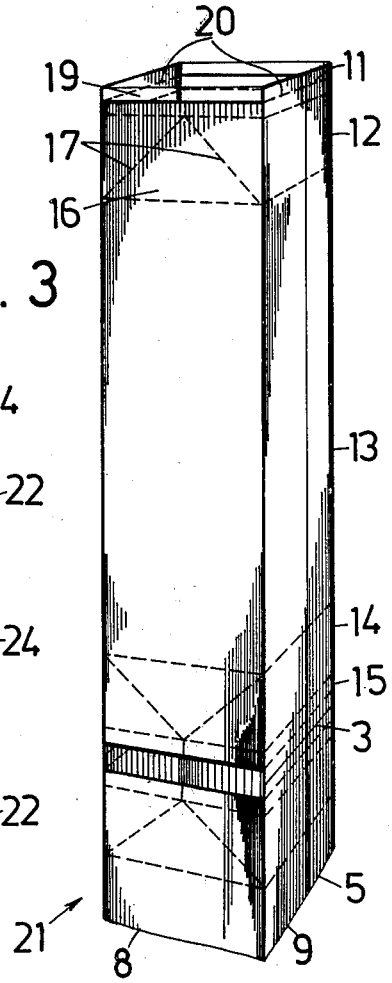
FIG. 3 shows part of the strip of FIG. 1 and which has been folded to become a tube.

The forming of blanks 2 belonging to the strip 1 into packages is accomplished in that the strip is, to begin with, folded to become a tube 21 of square cross section. FIG. 3 illustrates part of such a tube 21 folded from a strip 1 as shown in FIG. 1, this tube having been cut off on top along the boundary 3 between two consecutive blanks 2. In practice, the manufacturing of packages is carried out so that at first the apertures 18 are cut out from the strip 1 and the folding lines 4, 10, 17 and 20 are produced. Thereafter the strip is coated on both sides with a plastic film, which continues over the apertures 18. The strip is placed in the packaging machine in the form of a roll, which is in continuous action folded to produce a tube 21 as shown in FIG. 3, where the longitudinal zones 5 and 9 of the strip have been partly overlapped and bonded to form a seam. The substance to be packed is supplied into the tube 21, which is simultaneously in motion downwardly. After one package blank has been filled, a seaming operation is carried out with the aid of hot press rolls, in which operation the top end of the lower, filled package and the bottom of the upper package are both formed at the same time. When packing liquids, it is advantageous to perform the seaming below the liquid level in the tube 21, whereby the excess liquid quantity is pressed up at the seaming operation into the upper package blank. The supply of liquid into the tube 21 may then proceed without interruption. Finally, the packages are separated by cutting at the dividing line 3.

Figure 4:
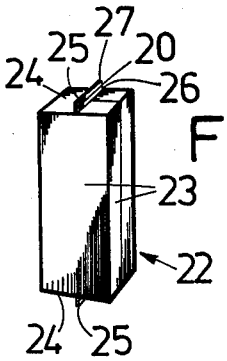
FIG. 4 shows a package made by folding a blank from the strip of FIG. 1 and which has been detached from the strip after seaming its ends.
Figure 5:
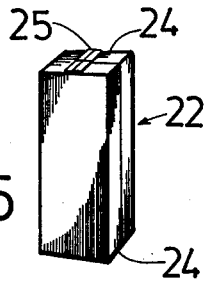
FIG. 5 shows the finished package made from a blank of the strip of FIG. 1.

FIG. 4 presents a package 22 formed of a blank 2 belonging to a strip 1 as shown in FIG. 1 and which has been separated from the strip after seaming. The package 22 has rectangular sides 23 and square ends 24. The seams 25 in the ends 24 are composed of two superimposed parts 26 and 27 separated by the folding line 20. The lower part 26 of the seam 25 comprises four opposed cardboard layers which have become adherent to each other at the seaming step due to melting of the plastic on the surface of the cardboard by the hot press roll. The part 26 comprises those parts of the transversal zone 11 or 15 of the blank 2 which lie between the transversal folding line 10 confining the respective transversal zone and the line formed by the folding lines 20. The upper part 27 of the seam 25 comprises those parts of the zone 11 or 15 which lie between the folding lines 20 and the boundary 3 between blanks. When the blank 2 is being folded to become a package 22, the plastic covering the apertures 18 will be doubled in the upper part 27 of the seam to be sandwiched between two opposed cardboard layers. At the seaming step, the press roll melts the plastic, which binds the cardboard layers together. In view of facilitating the handling of the finished package 22, the seams 25 may be folded down to parallel the ends 24 as shown in FIG. 5.

Figure 6:
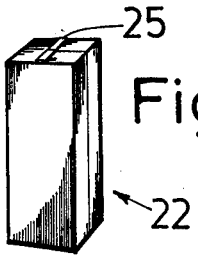
FIG. 6 shows a finished package made from a blank of the strip of FIG. 2.
Figure 7:
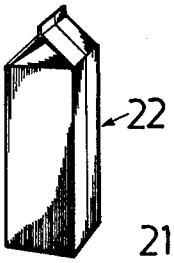
FIG. 7 shows a package made from a blank of a strip according to a third embodiment of the invention.

The finished package 22 folded from the blank 2 of the strip 1 as shown in FIG. 2 is illustrated by FIG. 6. In this case the end seam 25 of the package comprises only one part composed of two opposed cardboard layers. The plastic covering the apertures 18 has been doubled and sandwiched between these cardboard layers at the seaming step. A package 22 as shown in FIG. 7 can be folded from a blank differing from the blanks 2 belonging to a strip 1 as shown in FIG. 2 in that the breadth of the transversal zone 12 is greater than half the breadth of the transversal zones 6 and 8. Accordingly, the angles which the folding lines 10 and 17 form together are also larger.

It is obvious to one skilled in the art that various embodiments of the invention are not confined to the examples presented in the foregoing and that they may vary within the scope of the attached claims. For instance, the protective scope of the claims also covers those strips in which the longitudinal zone 7 is wider than the zones 6 and 8. The result is then a package with rectangular cross section. The mutual proportions of the dimensions of various parts of the strip may also vary in other respects. The use of a cardboard strip according to the invention, for instance one covered with polyethylene, is particularly advantageous in the uninterrupted packaging of a milk product, in which operation the production rate may be as high as 7000 packages per hour. The plastic coating may then be provided either on both sides of the strip or on one side only.

I claim:

1. A web of package blanks made of cardboard being shaped to form individual packages, in which each blank includes: a plurality of longitudinal folding lines dividing each of the blanks into longitudinal zones; four transverse folding lines formed on each of the blanks dividing the respective blanks into five transverse zones; and oblique folding lines formed at intersections between the two transverse zones adjacent to a middlemost transverse zone and two longitudinal zones adjacent to an intermediate longitudinal zone permitting the blank to be folded to a package; said middlemost transverse zone being adapted to form rectangular sides of the package; said two transverse zones adjacent to said middlemost zone provides end portions of the package and outermost transverse zones provide seams which seal the package at both of said ends; cutout areas provided in intersections between said outermost transverse zones and said longitudinal zones adjacent to said intermediate longitudinal zone, said cutout areas being covered with plastic material adapted to fold between opposed cardboard layers, as the blank is folded so as to provide sealing material at said seams, said web having a continuous strip of consecutive non-parallel blanks in which said longitudinal folding lines travel in the direction of the web, said transverse folding lines being perpendicular to said direction and said cutout areas being situated at the borderlines between adjacent blanks to thereby permit the web to be folded to the shape of a tube and to form a plurality of packages without the need of cutting the blanks apart.

2. A web of package blanks according to claim 1, employing plastic-coated cardboard wherein: the plastic coating of the cardboard continues on both sides of the strip over the apertures so that each aperture is covered by two superimposed plastic layers.

3. A web of package blanks according to any one of claims 1 or 2, wherein: the length of the apertures is the same as the breadth of those longitudinal zones in which the apertures are located.

4. A web of package blanks according to claim 3, wherein: the breadth of the apertures is the same as the combined widths of the edgemost transversal zones of two consecutive blanks bordering on the dividing line.

* * * * *